US007516695B2

(12) United States Patent
Baba et al.

(10) Patent No.: US 7,516,695 B2
(45) Date of Patent: Apr. 14, 2009

(54) PRESS MACHINE

(75) Inventors: Kiyokazu Baba, Komatsu (JP); Seiji Seki, Komatsu (JP); Shouji Watanabe, Komatsu (JP); Yuichi Suzuki, Komatsu (JP)

(73) Assignees: Komatsu Ltd., Tokyo (JP); Komatsu Industries Corp., Komatsu-shi (JP)

( * ) Notice: Subject to any disclaimer, the term of this patent is extended or adjusted under 35 U.S.C. 154(b) by 0 days.

(21) Appl. No.: 11/886,347

(22) PCT Filed: Mar. 13, 2006

(86) PCT No.: PCT/JP2006/304850

§ 371 (c)(1),
(2), (4) Date: Dec. 26, 2007

(87) PCT Pub. No.: WO2006/098253

PCT Pub. Date: Sep. 21, 2006

(65) Prior Publication Data

US 2008/0178652 A1 Jul. 31, 2008

(30) Foreign Application Priority Data

Mar. 16, 2005 (JP) ..... 2005-075394

(51) Int. Cl.
*B30B 1/26* (2006.01)
*B30B 15/06* (2006.01)

(52) U.S. Cl. ..... 100/257; 100/291; 100/282; 72/446; 72/452.5; 72/456; 74/44

(58) Field of Classification Search ..... 100/257, 100/280, 282, 287, 291; 72/441, 452.1, 452.5, 72/452.7, 446, 448, 455, 456; 83/527, 530; 74/44, 586
See application file for complete search history.

(56) References Cited

U.S. PATENT DOCUMENTS 4,674,357 A * 6/1987 Sugawara et al. ..... 74/590

(Continued)

FOREIGN PATENT DOCUMENTS

JP 51-31975 3/1976

(Continued)

OTHER PUBLICATIONS

Notification Concerning Transmittal of International Preliminary Report on Patentability, Chapter I of the Patent Cooperation Treaty, Sep. 18, 2007 for PCT/JP2006/304850, 5 sheets.

*Primary Examiner*—Jimmy T Nguyen
(74) *Attorney, Agent, or Firm*—Frishauf, Holtz, Goodman & Chick, P.C.

(57) ABSTRACT

A rotary ring (34) formed such that an outer circumference is eccentric with respect to an inner circumference is provided to an outer circumference of an eccentric drum (333) of an eccentric shaft (33). An adjustment ring (41) formed such that an outer circumference is eccentric with respect to an inner circumference is provided to the outer circumference of the rotary ring (34), and a slide (5) is mounted to the outer circumference of the adjustment ring (41). Since the slide (5) and a slide drive unit (30) are arranged to be superposed substantially at the same height, a distance between the slide drive unit (30) and a lower end of the slide (5) can be reduced and the entire height of a servo press (1) can be reduced. In addition, since the height position of the slide (5) can be finely adjusted by rotating the adjustment ring (41), a press working can be performed with high accuracy.

4 Claims, 7 Drawing Sheets

U.S. PATENT DOCUMENTS

| | | | | |
|---|---|---|---|---|
| 4,761,988 | A * | 8/1988 | Kato | 72/452.5 |
| 6,877,422 | B2 * | 4/2005 | Hisanobu et al. | 100/257 |
| 7,013,800 | B2 * | 3/2006 | Kanamaru et al. | 100/257 |

FOREIGN PATENT DOCUMENTS

| | | | |
|---|---|---|---|
| JP | 58-192698 | A | 11/1983 |
| JP | 2004-202501 | A | 7/2004 |
| JP | 2005-211984 | A | 8/2005 |

* cited by examiner

PRESS MACHINE

This application is a U.S. National Phase Application under 35 USC 371 of International Application PCT/JP2006/304850 field Mar. 13, 2006.

TECHNICAL FIELD

The present invention relates to a press machine, in particular, a press machine for performing a press working such as sheet metal working, in which a high accuracy is required.

BACKGROUND ART

As a conventional press machine, there exists a forging press apparatus for forging by converting a rotating motion of a crankshaft into a lifting-up-and-down motion of a slide (see, for example, Patent Document 1). The forging press apparatus has a swing rod into which a crankshaft is penetrated, with an upper end of the swing rod being rotatably supported on a slide by a shaft rod. At a lower end of the swing rod, an arcuate surface is formed with the shaft rod being at its center, and the slide is held in contact with the arcuate surface via a liner.

In the forging press apparatus, when the crankshaft is rotated, the slide is lifted up and down, with the swing rod being swung around the shaft rod. With this arrangement, as compared with a conventional apparatus in which a connecting rod is connected to the crankshaft and the slide is attached to the connecting rod, a distance from the crankshaft to the slide can be reduced, so that the entire height of the forging press apparatus can be reduced.

[Patent Document 1] JP-A-51-31975

DISCLOSURE OF THE INVENTION

Problems to be Solved by the Invention

However, in the forging press apparatus according to Patent Document 1, since the swing rod is mounted to the slide while the arcuate surface of the swing rod is held in contact with the slide via the liner, the height position of the slide cannot be corrected. Although there is no serious problem in a forging press apparatus, in which no specific high accuracy is usually required, a function to finely adjust the slide height is indispensable in securing a required accuracy in, for example, press working on thin plates or sheet metal working, in a which high working accuracy is required,. Accordingly, when a press machine required to perform a press working with high accuracy is configured similarly to the above-mentioned forging press apparatus in order to achieve a reduction in the entire height of the press machine, the height of the slide cannot be adjusted, and press working cannot be performed with high accuracy.

An object of the present invention is to provide a press machine with which an entire height can be reduced while an accuracy of press working can be sufficiently secured.

Means for Solving the Problems

A press machine according to an aspect of the present invention includes: an eccentric shaft; an eccentric annular member provided to be slidable with respect to an outer circumference of the eccentric shaft, and formed such that an outer circumference is eccentric with respect to an inner circumference; a slide provided to the outer circumference of the eccentric annular member; and a slide adjusting device adapted to adjust a height position of the slide with respect to the eccentric annular member.

According to the aspect of the present invention, the eccentric annular member is slidably provided to the eccentric shaft while the slide is provided to the outer circumference of the eccentric annular member. With this arrangement, when the eccentric shaft is rotated, the eccentric annular member absorbs the movement in the horizontal direction of the eccentric shaft while rotating with respect to the eccentric shaft, such that only the movement in the vertical direction is transmitted to the slide to lift up and down the slide. Unlike a conventional configuration in which a connecting rod is connected to the eccentric shaft, the eccentric annular member corresponding to the connecting rod is formed to be annular, whereby the horizontal movement of the eccentric shaft can be absorbed with the height dimension further reduced and the distance from the eccentric shaft to the lower end of the slide is shortened. Thus, the entire height of the press machine is reduced.

Further, since the slide adjusting device is adapted to adjust the slide height with respect to the eccentric annular member, the slide height can be finely adjusted. Thus, unlike a conventional apparatus, a press working can be performed with high accuracy while a reduction in the entire height of the slide is realized. Accordingly, the press machine can be applicable to a wider variety of molding work such as sheet metal press working, in which high working accuracy is required, thereby improving usability of the press machine.

In the press machine according to the aspect of the present invention, it is preferable that the slide adjusting device includes: an adjustment annular member formed such that an outer circumference is eccentric with respect to an inner circumference, the inner circumference being slidable with respect to the outer circumference of the eccentric annular member, the slide being mounted to the outer circumference; and an adjusting drive unit rotating the adjustment annular member.

According to the aspect of the present invention, since the outer circumference of the adjustment annular member is eccentric with respect to the inner circumference thereof, when the adjustment annular member is rotated by the adjusting drive unit, the distance between the outer circumference of the eccentric annular member and the inner circumference of the slide is changed. With this arrangement, the slide moves in the height direction with respect to the eccentric annular member, such that the slide height is adjusted.

Since the slide height is adjusted by the adjustment annular member, the slide height can be adjusted in a nonstep manner. Further, since the slide height can be adjusted by rotating the adjustment annular member, the adjustment amount of the slide height can be easily ascertained by controlling the rotating angle or the like of the adjustment annular member, thereby realizing a fine adjustment of the slide height with high accuracy.

In the press machine according to the aspect of the present invention, it is preferable that a slide bearing be provided between the eccentric shaft and the eccentric annular member and between the eccentric annular member and the adjustment annular member.

According to the aspect of the present invention, since the slide bearing is interposed between the eccentric shaft and the eccentric annular member and between the eccentric annular member and the adjustment annular member, the sliding movement of the members can be favorably and smoothly performed. Further, since the slide bearings are interposed, wear of those members due to friction therebetween is reduced, thereby increasing the life of the press machine.

Since the slide bearing is simply structured, the structure of a power transmission mechanism for transmitting power from the eccentric shaft to the slide is simplified, thereby facilitating the production, maintenance, etc. of the press machine.

In the press machine according to the aspect of the present invention, it is preferable that a rolling bearing be provided between the eccentric shaft and the eccentric annular member and between the eccentric annular member and the adjustment annular member.

According to the aspect of the present invention, since the rolling bearing is interposed between the eccentric shaft and the eccentric annular member and between the eccentric annular member and the adjustment annular member, the sliding movement of the members can be favorably and smoothly performed. Further, since the rolling bearings are interposed, the friction between those members is suppressed to a minimum, thereby preventing wear of the members and increasing the life of the press machine.

In the press machine according to the aspect of the present invention, it is preferable that the center of the outer circumference of the eccentric annular member be arranged to be vertically above the rotation center of the eccentric shaft.

According to the aspect of the present invention, since the center of the inner circumference of the eccentric annular member is arranged to be vertically above the rotation center of the eccentric shaft, the slide speed near the bottom dead center of the slide is reduced. Thus, as compared with a case in which the center of the inner circumference of the eccentric annular member is arranged to be vertically below the rotation center of the eccentric shaft, a larger molding load can be obtained at the time of molding, thereby realizing a press working with higher efficiency.

EXPLANATION OF CODES

Figure 1:
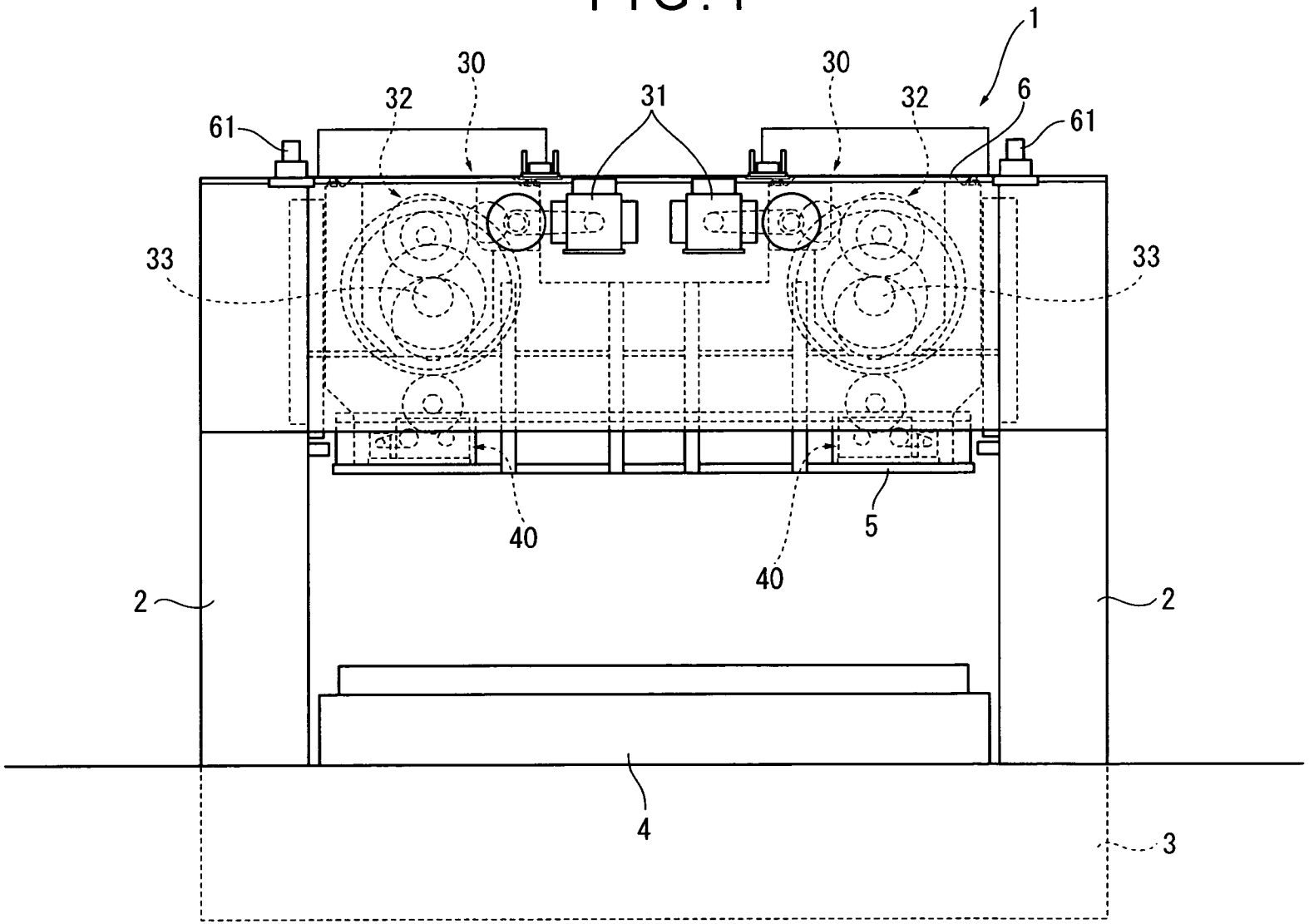
FIG. 1 is an overall view showing a press machine according to a first embodiment of the present invention.

1: servo press (press machine)
5: slide
30 slide drive unit
33: eccen shaft (eccentric shaft)
34: rotary ring (eccentric annular member)
40: slide adjusting device
41: adjustment ring (adjusting annular member)
44: adjusting drive unit
333: eccentric drum
341, 342: bushing (slide bearing)
343: spherical roller bearing (rolling bearing)
344: cylindrical roller bearing (rolling bearing)

BEST MODE FOR CARRYING OUT THE INVENTION

Embodiments of the present invention will be described with reference to the drawings below. Note that in a second embodiment described below, the same components and components that perform the same function as in a first embodiment described below are indicated by the same numerals, whose description will be simplified or omitted.

FIRST EMBODIMENT

FIG. 1 is an overall view showing a servo press 1 (press machine) according to a first embodiment of the present invention. In FIG. 1, the left-hand side corresponds to a front side of the servo press 1 while the right-hand side corresponds to a rear side of the servo press 1. As shown in FIG. 1, in the servo press 1, four pillar-like uprights 2 (only two of which are shown) are provided to be upright on an upper surface of a bed 3. On an upper side of the bed 3, a bolster 4 is placed to be surrounded by the four uprights 2. A crown 6 is provided on upper sides of the uprights 2. A tie rod 61 skewers to fasten the crown 6, the upright 2 and the bed 3. On the crown 6, which bears a slide 5, a slide drive unit 30 for moving up and down (lifting up and down) the slide 5 is provided.

When the slide 5 is moved up and down by the slide drive unit 30, a workpiece placed between a lower die provided on the upper surface of the bolster 4 and an upper die provided on the lower surface of the slide 5 is press worked.

Figure 2:
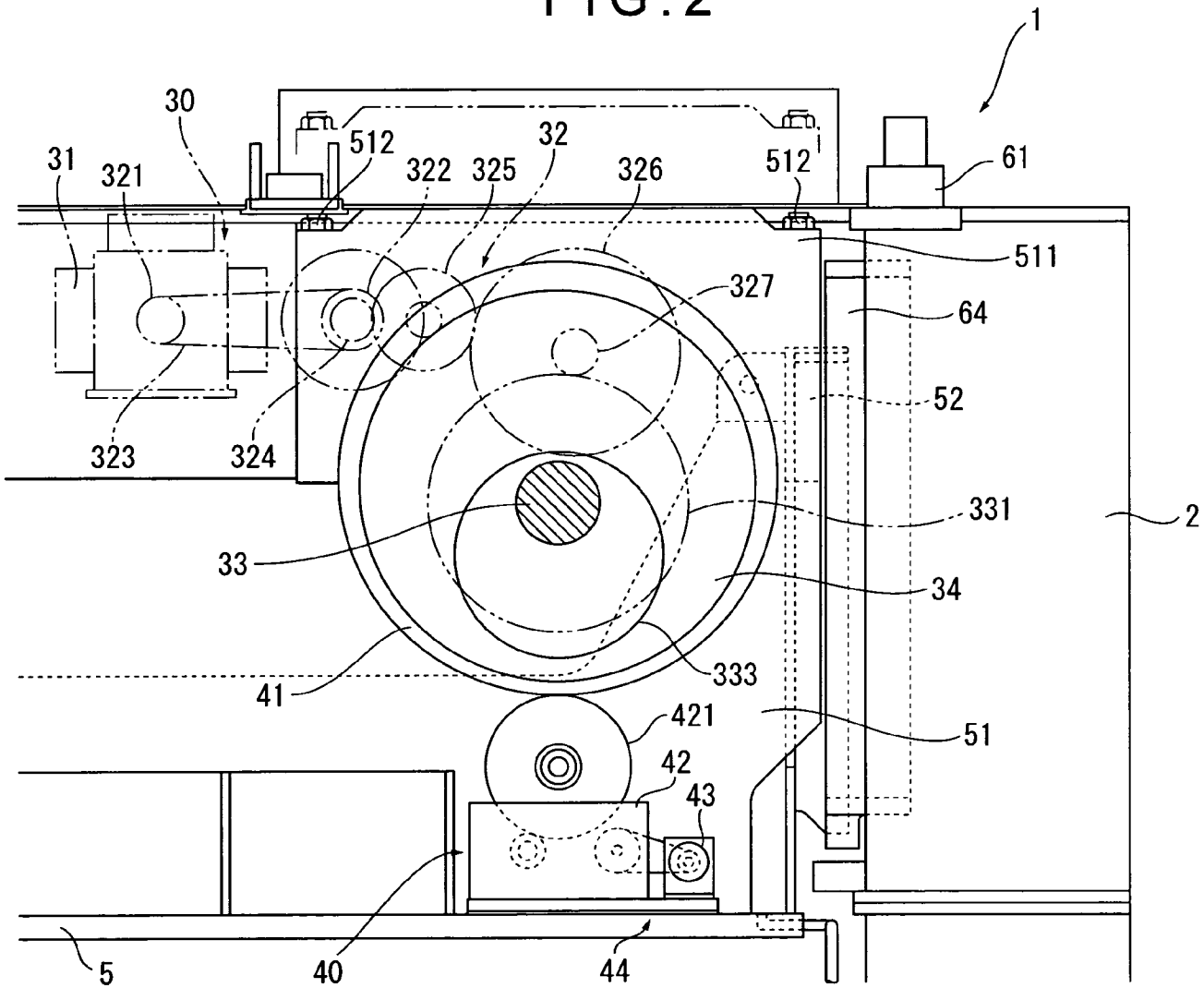
FIG. 2 is a partially enlarged view showing the press machine according to the first embodiment of the present invention.
Figure 3:
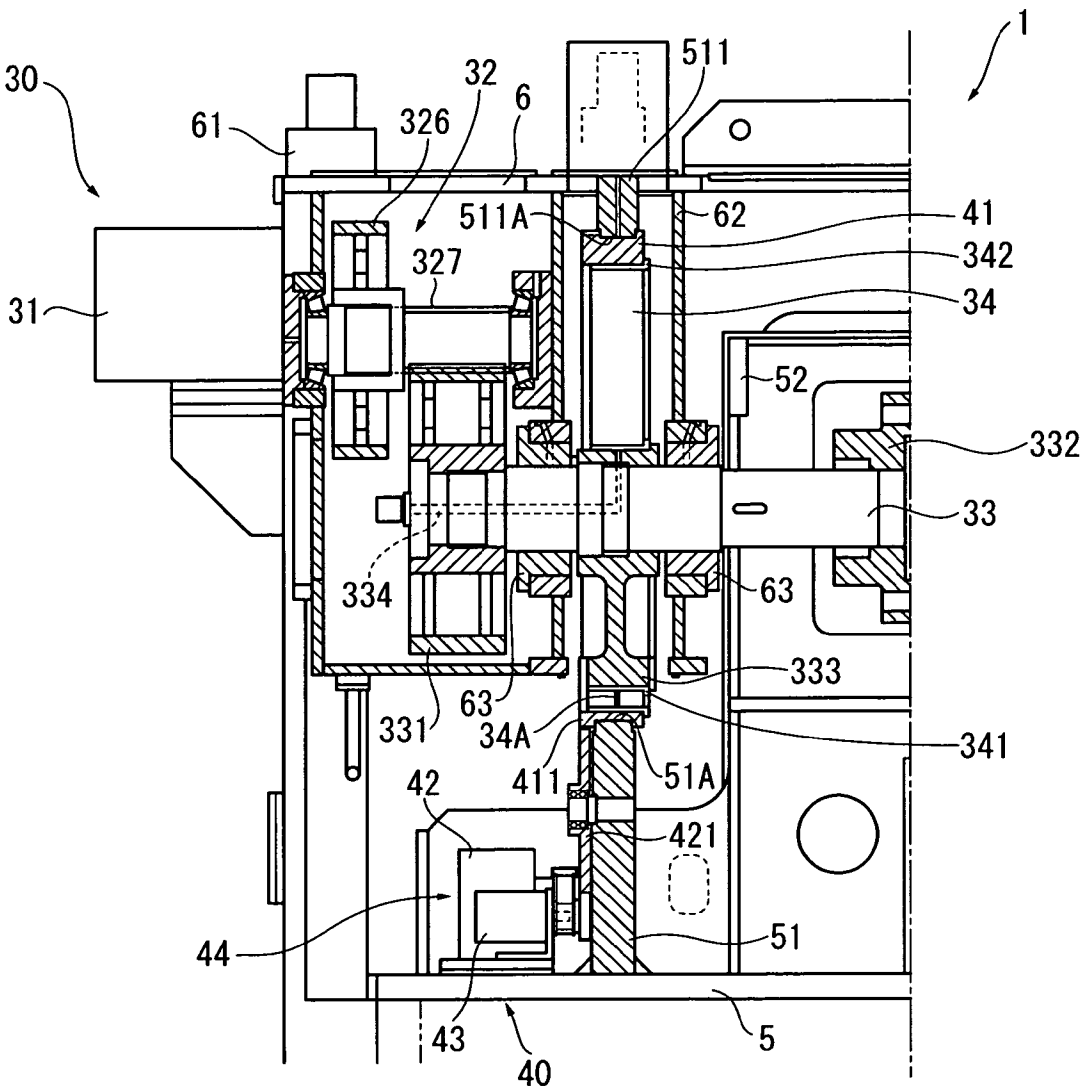
FIG. 3 is a partially enlarged side-sectional view showing the press machine according to the first embodiment of the present invention.

FIG. 2 is an enlarged view showing the slide drive unit 30, and FIG. 3 is an enlarged side-sectional view showing the slide drive unit 30. As shown in FIGS. 2 and 3, the slide drive unit 30 includes a servo motor 31 as a drive source, a deceleration mechanism 32 for decelerating to transmit a rotation of the servo motor 31, an eccen shaft 33 (eccentric shaft) rotated by a rotation power from the deceleration mechanism 32, and a rotary ring 34 (eccentric annular member)swung by the rotation of the eccen shaft 33.

Two slide drive units 30 are provided in the front-and-rear direction of the servo press 1, each eccentric shaft 33 of which provided with two rotary rings 34. Thus, the servo press 1 according to the present embodiment is of a four-point type, with which the slide 5 is supported at four points.

The servo motor 31 is externally provided to a lateral side of the crown 6. With this arrangement, there is no need to climb up on the upper surface of the crown 6 for a maintenance of the servo motors 31, thereby facilitating the maintenance operation.

The deceleration mechanism 32 includes a small pulley 321 fixed to an output shaft of the servo motor 31, a large pulley 322 rotatably supported by the crown 6, a belt 323 wound around the small pulley 321 and the large pulley 322, a first pinion 324 provided integrally with the large pulley 322, an idler 325 meshing with the first pinion 324, a first gear 326 meshing with the idler 325, and a second pinion 327 provided integrally with the first gear 326. The second pinion 327 is meshed with a circumference gear 331 fixed to the eccen shaft 33.

The eccen shaft 33 includes two divisional portions (only one of which is shown in FIG. 3)whose ends are coupled together by a coupling 332. An eccentric drum 333 is formed integrally with each of the divisional portions of the eccen shaft 33. Both sides of the eccentric drum 333 in a shaft direction are rotatably supported by bearings 63 mounted to a crown frame 62.

A configuration of the eccen shaft 33 is not limited to the configuration in which the eccen shaft 33 includes two divisional portions. The eccen shaft 33 may be configured as a single eccentric shaft in which no divisional portion is included, to which two rotary rings (eccentric annular members) may be attached.

The rotary ring 34 is formed as an annular member in which an outer circumference is eccentric with respect to an inner circumference. The inner circumference of the rotary ring 34 is arranged to be slidable on the outer circumference of the eccentric drum 333 via a bushing (slide bearing) 341. Since the bushing 341 is provided between the eccentric drum 333 and the rotary ring 34, the sliding operation of the two components are favorably performed. With this arrangement, a wear reduction of the outer circumference of the eccentric drum 333 and the inner circumference of the rotary ring 34 can be achieved, thereby improving durability of the slide drive unit 30. Oil is supplied to the inner circumference of the rotary ring 34 from an oil filler hole 334 formed inside the eccen shaft 33 via a rotary connection.

At a top dead center (see FIG. 4(A)) or a bottom dead center (see FIG. 4(C)) of the slide 5, a distance between the outer circumference and the inner circumference of the rotary ring 34 is minimized at an immediately lower portion thereof. In this manner, the center $C_2$ of the outer circumference of the rotary ring 34 is arranged above the rotation center $C_1$ of the eccen shaft 33 (what is called, an underdrive arrangement). Consequently, since a change in the distance between the outer circumference and the inner circumference of the rotary ring 34 decreases in the vicinity of the bottom dead center of the slide 5, the movement speed of the slide 5 can be slowed down. Thus, the speed of the slide 5 is slowed in a region where the workpiece is molded, whereby press molding can be favorably performed.

In the outer circumference of the rotary ring 34, there is arranged an annular adjustment ring 41 (adjusting annular member) whose outer circumference is eccentric with respect to an inner circumference. The adjustment ring 41 is mounted to the rotary ring 34 via a bushing (slide bearing) 342, so that the rotary ring 34 is rotatable while sliding on the inner circumference of the adjustment ring 41. Since the bushing 342 is provided between the adjustment ring 41 and the rotary ring 34, the sliding operation of the two components can be favorably performed. With this arrangement, a wear reduction of the outer circumference of the rotary ring 34 and the inner circumference of the adjustment ring 41 can be achieved, thereby improving durability of the slide drive unit 30.

In a lower side of the rotary ring 34, there is formed an oil filler hole 34A penetrating from the inner circumference to the outer circumference, and oil supplied to the inner circumference of the rotary ring 34 is supplied to the outer circumference of the rotary ring 34 through the oil filler hole 34A.

When, at the top dead center of the slide 5, a distance from the rotation center $C_1$ of the eccen shaft 33 to the center $C_3$ of the eccentric drum 333 is defined as a distance A (see FIG. 4(A)) while a distance from the rotation center $C_1$ of the eccen shaft 33 to the center $C_2$ of the outer circumference of the rotary ring 34 is defined as a distance B (see FIG. 4(A)), a connecting rod ratio $\gamma$ can be represented by an equation of $\gamma=B/A$. The larger a value of the connecting rod ratio $\gamma$ is, the larger a molding load can be obtained with the same torque. On the other hand, the larger the connecting rod ratio $\gamma$ is, the larger an entire height dimension of the slide drive unit 30 becomes. Thus, it is desirable that the connecting rod ratio $\gamma$ is appropriately set taking into account specifications such as a required molding load value and the entire height of the servo press 1.

In particular, in the slide drive unit 30 according to the present embodiment, at the top dead center or the bottom dead center of the slide 5, the center $C_3$ of the inner circumference of the rotary ring 34 is arranged to be located vertically below the center $C_2$ of the outer circumference thereof (what is called, an underdrive arrangement). Consequently, when the connecting rod ratio $\gamma$ is approximated to 1 so that the entire height of the servo press 1 is reduced, the lifting-down speed of the slide 5 can be kept at an extremely low level (or macroscopically kept at rest) around the bottom dead center (i.e., what is called, dwell motion). Thus, in the servo press 1 according to the present embodiment, a low-speed molding around the bottom dead center can be realized while the connecting rod ratio $\gamma$ is approximated to 1 so that the entire height of the servo press 1 is reduced, whereby a press molding is advantageously performed.

The slide 5 is provided with an attachment member 51 for mounting the slide 5 to the outer circumference of the adjustment ring 41. The plate-like attachment member 51, which has a surface perpendicular to the axial direction of the eccen shaft 33, is provided in a pair to correspond to the position where the rotary ring 34 is provided. On an upper side of the attachment member 51, a detachable mounting cap 511 is provided, which is fixed to the attachment member 51 by a bolt 512.

In end surfaces at which the attachment member 51 and the mounting cap 511 are in contact with each other, substantially semi-circular cutouts 51A, 511A are formed, on a circular portion provided inside of which the adjustment ring 41 is arranged. The adjustment ring 41 is arranged so as to be slidable with a predetermined frictional force with respect to the slide 5 (attachment members 51 and mounting cap 511).

The mounting cap 511 can be separated from the attachment members 51 of the slide 5. Accordingly, when the slide 5 is mounted to the adjustment ring 41, the eccen shaft 33 attached with the adjustment ring 41 may be fitted into the cutout 51A of the attachment member 51 from above, so that the mounting cap 511 is placed on the attachment member 51 to be fixed thereto by the bolt 512, whereby the mounting operation is facilitated.

Each of the mounting members 51 is mounted with one rotary ring 34 of the two slide drive units 30. By rotating the two servo motors 31 in opposite directions, a driving balance of the slide 5 is maintained.

Further, since the slide 5 is mounted to the outer circumference of the adjustment ring 41, the slide 5 is located at a position to surround the slide drive unit 30 including the eccen shaft 33, the rotary ring 34, etc. With this arrangement, as compared with a conventional arrangement in which the slide is mounted via a connecting rod and a plunger, the slide 5 can be arranged substantially at the same height as the slide drive unit 30 to be formed integrally therewith, thereby advantageously space saving. Thus, the distance between the slide drive unit 30 and the lower end of the slide 5 can be shortened, whereby the entire height of the servo press 1 can be reduced. Consequently, the servo press 1 can be also transferred in an assembled state, so that an assembling operation can be performed in a manufacturing plant for the servo press 1, thereby shortening an installing operation of the servo press 1.

Since the entire height of the servo press 1 can be reduced, a height of a building for housing the servo press 1 can be reduced. Thus, it is possible to economize on air-conditioning expense or the like. Further, since the entire height of the servo press 1 can be reduced, it is possible to reduce a length of the tie rods 61. Thus, it is possible to improve a rigidity of the servo press 1.

Further, since the rotary ring 34 is mounted to the outer circumference of the eccentric drum 333 and the slide 5 is mounted to the outer circumference of the rotary ring 34 via the adjustment ring 41, a power transmission mechanism is entirely formed of circular or annular members, whereby the slide drive unit 30 in terms of strength can be improved as compared with a conventional structure in which the slide is mounted to the eccentric shaft via a rod-shaped connecting rod and plunger.

In the slide 5, between the pair of attachment members 51, a slide guide portion 52 is provided to protrude from an outer side surface of the slide 5. The slide guide portion 52 is engaged with a slide gib 64 provided on the upright 2. The slide guide portion 52 is moved along the slide gib 64, such that the slide 5 is lifted up and down restrictively in vertical direction. Since the slide gib 64 is arranged near the center between right and left uprights 2, the slide gib 64 and the slide guide portion 52 can be formed to be long, thereby lifting up and down the slide 5 with high accuracy.

On a portion of the outer circumference of the adjustment ring 41 with which neither the attachment members 51 nor the mounting cap 511 is contacted, a gear 411 is provided. The gear 411 is meshed with an idler 421, which is connected with a reducer 42 connected to a motor (adjusting drive source) 43. An adjusting drive unit 44 according to the present invention is provided by the idler 421, the reducer 42 and the motor 43.

When the motor 43 is driven, a rotary movement whose speed has been reduced to an appropriate speed by the reducer 42 is transmitted to the adjustment ring 41 through the idler 421 to rotate the adjustment ring 41. Accordingly, the frictional force at the contact surfaces between the adjustment ring 41 and the slide 5 needs to be set at a value at which the adjustment ring 41 is not rotated even if the rotary ring 34 is swung during press working. Further, the drive force of the motor 43 needs to be set at a value at which the adjustment ring 41 overcomes that frictional force to be rotated.

A slide adjusting device 40 according to the present invention is provided by the adjustment ring 41 and the adjusting drive unit 44.

Next, operations of the servo press 1 will be described.

Figure 4:
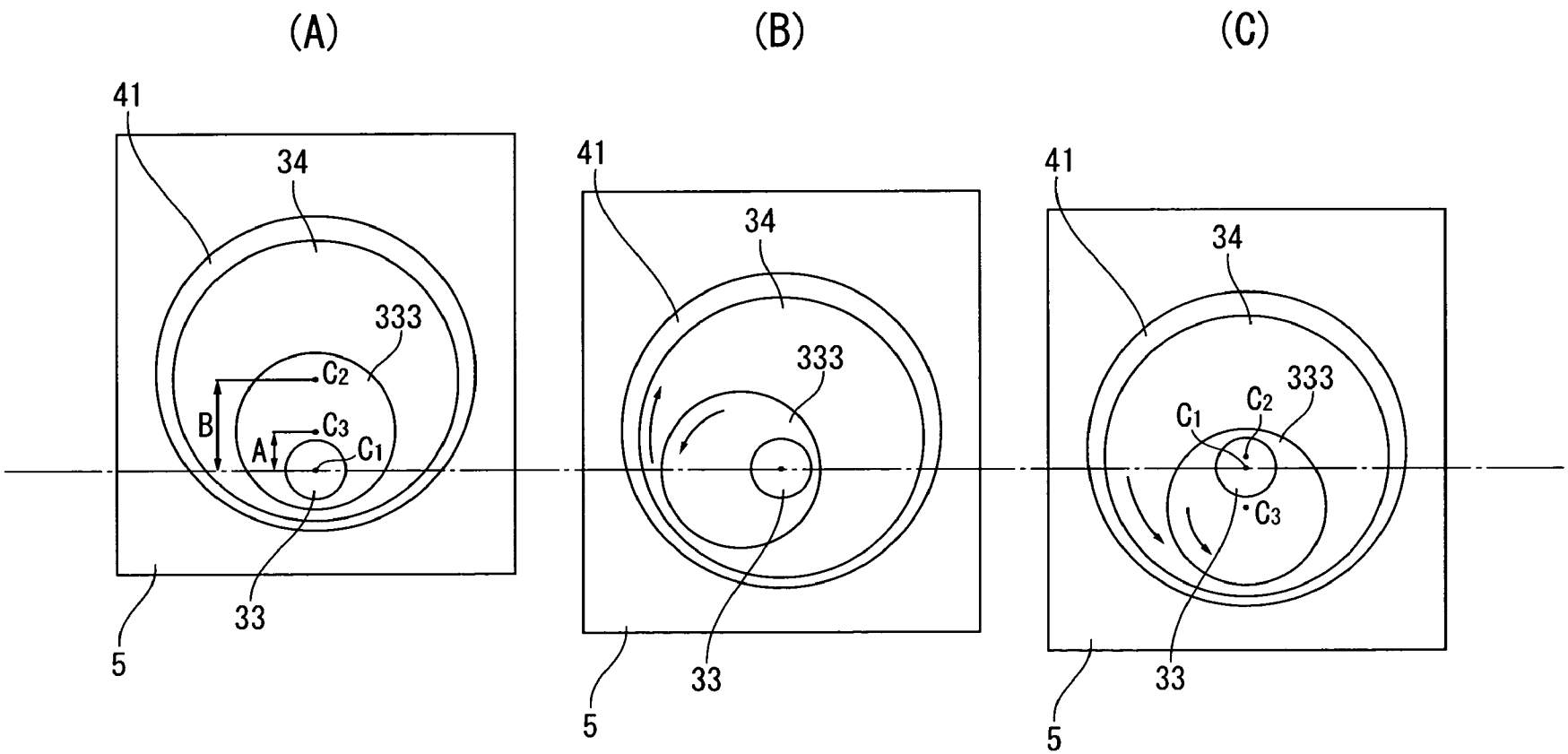
FIG. 4 is an illustration showing movements of a slide according to the first embodiment of the present invention.

FIG. 4 shows how the slide 5 is lifted up and down by the rotation of the eccen shaft 33. In FIG. 4, the eccen shaft 33, the rotary ring 34, the adjustment ring 41, and the slide 5 are schematically shown for a facilitation of understanding.

When the eccen shaft 33 is rotated in the state where the slide 5 is at the top dead center as shown in FIG. 4(A), the eccentric drum 333 is eccentrically rotated as shown in FIG. 4(B) in accordance with the rotation of the eccen shaft 33. At this time, since a horizontal movement of the outer circumference of the rotary ring 34 is restricted by the adjustment ring 41 and the slide 5, the rotary ring 34 is rotated in a direction opposite to the rotating direction of the eccentric drum 333 to absorb the horizontal movement amount. On the other hand, since the vertical position of the rotary ring 34 is lowered by the eccentric rotation of the eccentric drum 333, the entire slide 5 is lowered in accordance with the movement of the rotary ring 34.

When the eccen shaft 33 is further rotated, the slide 5 as a whole descends until it reaches the bottom dead center while the rotary ring 34 rotates in the same direction as the eccentric drum 333, as shown in FIG. 4(C).

In order to adjust the height position of the slide 5, the motor 43 of the slide adjusting device 40 is driven to rotate the adjustment ring 41 via the reducer 42.

Figure 5:
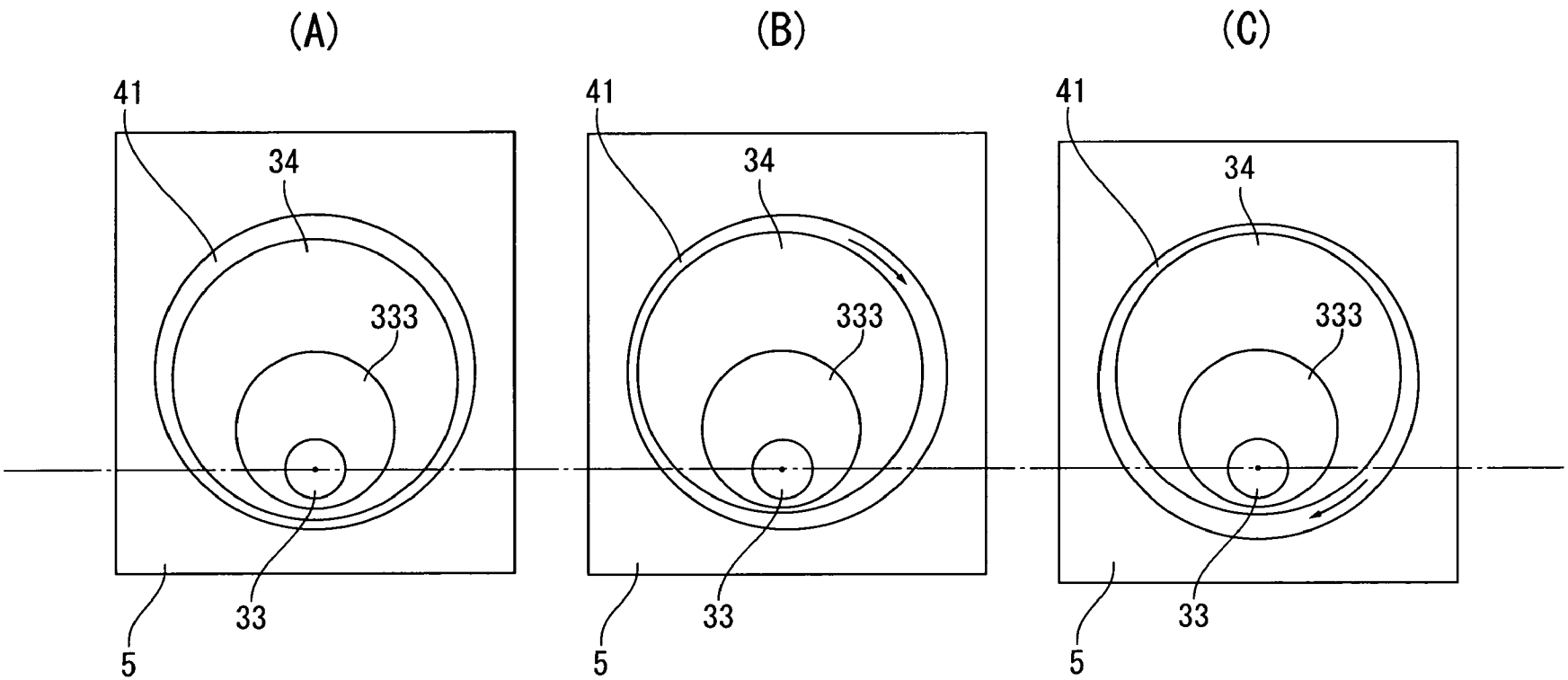
FIG. 5 is an illustration showing operations of a slide adjusting device according to the first embodiment of the present invention.

FIG. 5 shows how the height position of the slide 5 is adjusted by the slide adjusting device 40. In the state shown in FIG. 5(A), the adjustment ring 41 is arranged such that the portion of the adjustment ring 41 where the distance between the outer circumference and the inner circumference is minimized is located at the bottom. In this state, the slide 5 is adjusted to be at the highest position of the height adjustment range of the slide adjusting device 40. When the motor 43 is driven to rotate the adjustment ring 41 by a predetermined angle as shown in FIG. 5(B), the distances between the inner circumference and the outer circumference in the upper portion and the lower portion of the adjustment ring 41 undergo a change. In other words, the distance between the inner circumference and the outer circumference in the upper portion of the adjustment ring 41 is smaller than that in FIG. 5(A), and the distance between the inner circumference and the outer circumference in the lower portion of the adjustment ring 41 is larger than that in FIG. 5(A). Thus, the entire slide 5 is moved downward along the outer circumference of the adjustment ring 41. When the adjustment ring 41 is rotated to the position shown in FIG. 5(C), the slide 5 is further corrected downwardly. In the state shown in FIG. 5(C), the slide 5 is adjusted to be at the lowest position of the height adjustment range of the slide adjusting device 40.

Since the height position of the slide 5 can be finely adjusted by the slide adjusting device 40, press working can be conducted with high precision. Even in a press working in which a high press molding accuracy is required such as sheet metal press working, it is possible to obtain a satisfactory molding.

Further, since the height position of the slide 5 is adjusted by rotating the adjustment ring 41 using the slide adjusting device 40, the height adjustment of the slide 5 can be performed in a nonstep manner, thereby realizing a height adjustment with high accuracy. Since the height position of the slide 5 can be adjusted by driving the motor 43, the height adjustment can be performed with high accuracy by controlling a rotating angle or the like of the motor 43.

Further, since the adjustment ring 41 is formed to be annular, the adjustment ring 41 can be rotated also during operating the servo press 1, such that the height position of the slide 5 can be adjusted. Thus, there is no need to stop the servo press 1 for a fine adjustment of the height of the slide 5, thereby improving a productivity.

SECOND EMBODIMENT

Next, a second embodiment of the present invention will be described. The second embodiment is the same as the first embodiment, except that a mounting structure of the rotary ring 34 and the adjustment ring 41 of the servo press 1 is different from that of the first embodiment.

Figure 6:
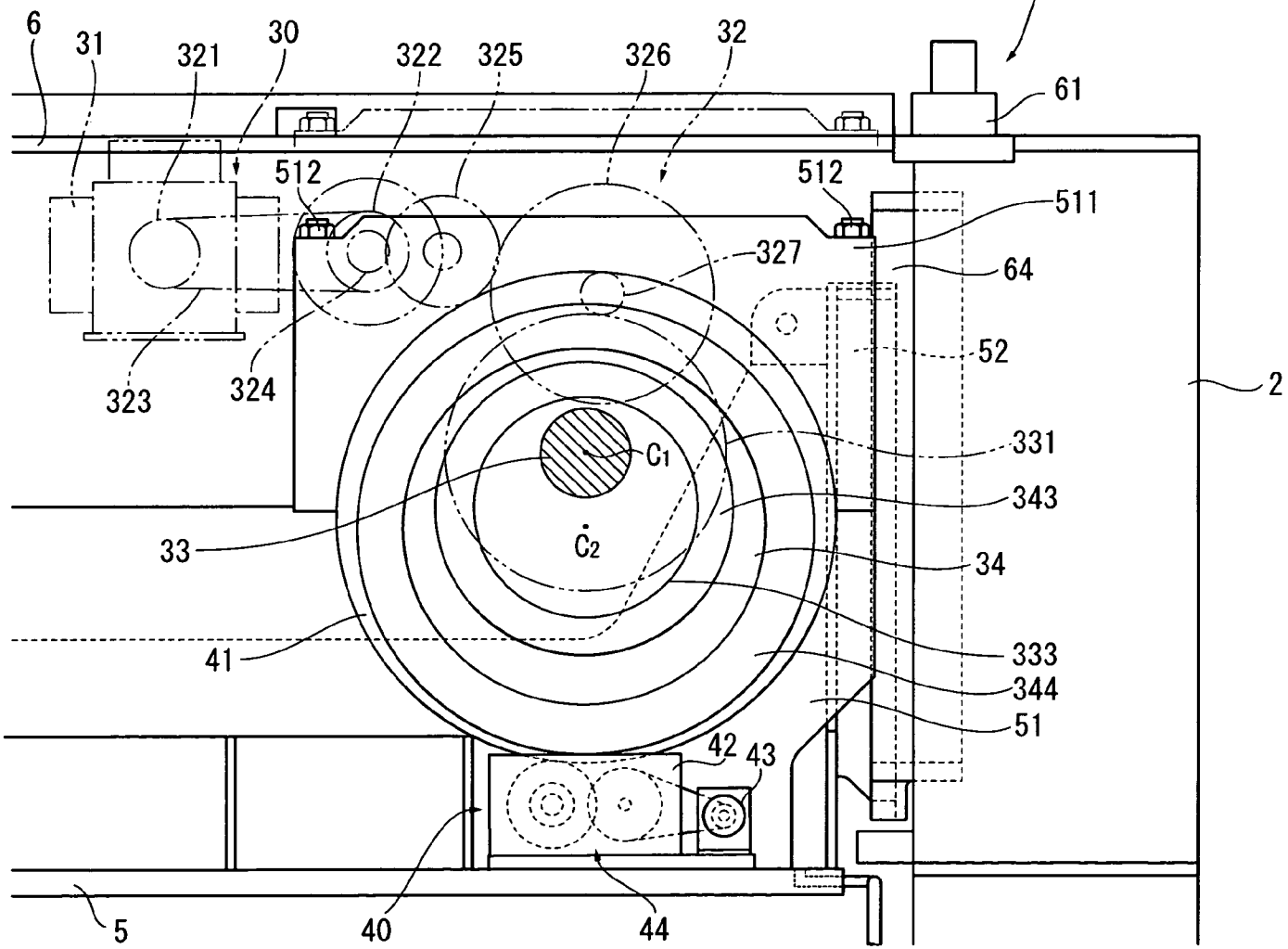
FIG. 6 is a partially enlarged view of a press machine according to a second embodiment of the present invention.
Figure 7:
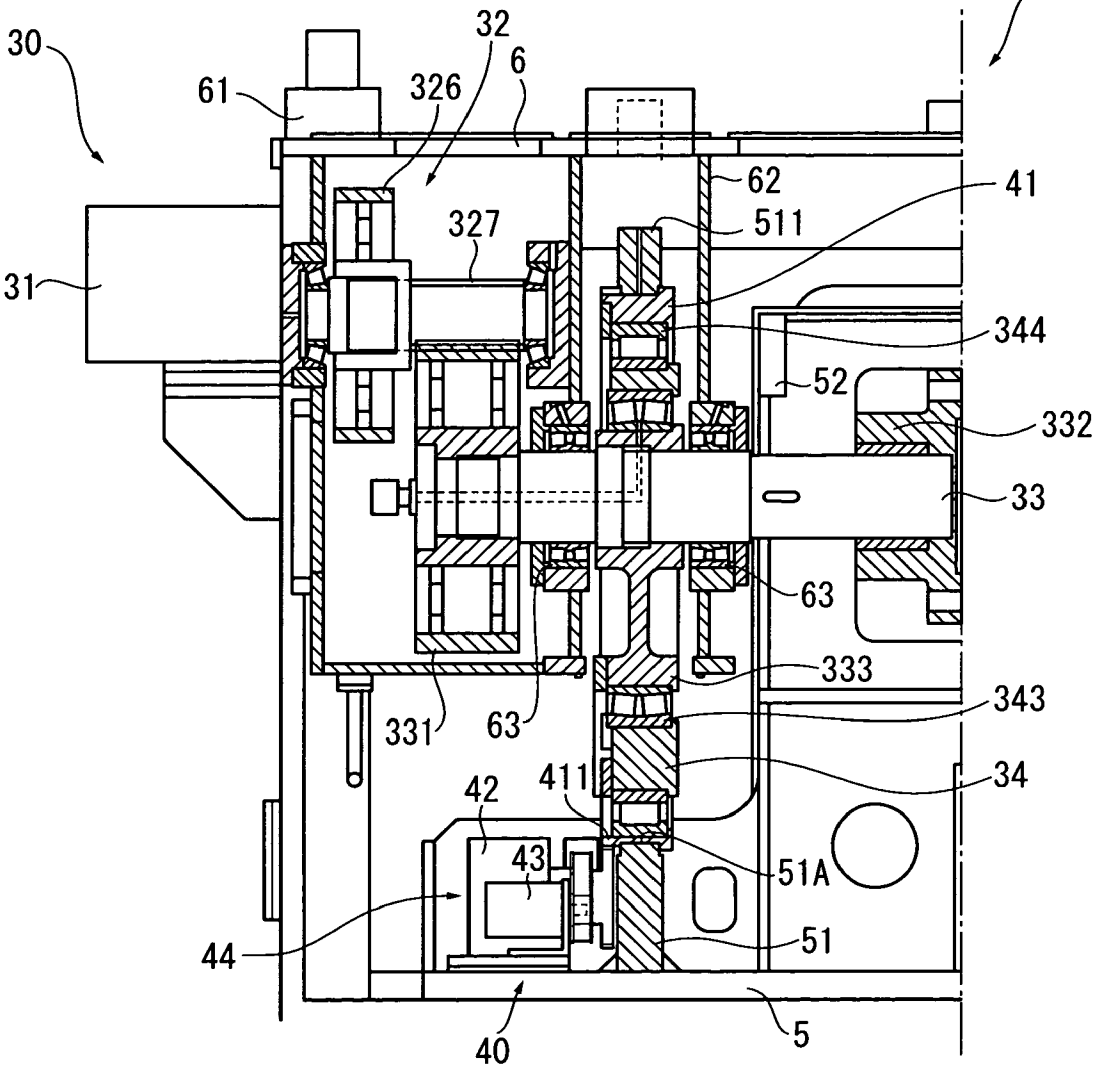
FIG. 7 is a partially enlarged side-sectional view of the press machine according to the second embodiment of the present invention.

FIG. 6 is an enlarged view showing the slide drive unit 30 of the servo press 1 according to the second embodiment. FIG. 7 is an enlarged side-sectional view of the slide drive unit 30. As shown in FIGS. 6 and 7, the rotary ring 34 of the slide drive unit 30 is mounted to the eccentric drum 333 via a spherical roller bearing 343 (rolling bearing). The adjustment ring 41 is mounted to the rotary ring 34 via a cylindrical roller bearing 344 (rolling bearing). Although the combination of the spherical roller bearing 343 and the cylindrical roller bearing 344 is adopted in consideration of the need for prevention of inclination, other arbitrary rolling bearings and combinations thereof may be used as desired.

Further, when the slide 5 is at the top dead center or the bottom dead center, the distance between the outer circumference and the inner circumference of the rotary ring 34 is minimized at the top. In this manner, since the center $C_2$ of the outer circumference of the rotary ring 34 is arranged below the rotation center $C_1$ of the eccen shaft 33 (what is called, a topdrive arrangement), the slide 5 is lifted up and down at a lower speed near the top dead center, which tends to be more conspicuous as the connecting rod ratio $\gamma$ approximates 1.

Unlike the first embodiment, the adjustment ring 41 of the slide adjusting device 40 is connected directly to the reducer 42 with no idler 421 being interposed therebetween.

According to the second embodiment described above, as in the first embodiment, the slide 5 is lifted up and down in accordance with the rotation of the eccen shaft 33 to perform press working. Also as in the first embodiment, when adjusting the height position of the slide 5, the adjustment ring 41 is rotated by driving the motor 43.

Note that the present invention is not limited to the above embodiments but may include any modifications, improvements or the like within a scope where an object of the present invention can be achieved.

For example, the bearing between the eccentric shaft and the eccentric annular member or the bearing between the eccentric annular member and the adjustment annular member may not necessarily be both slide bearings as in the first embodiment or both rolling bearings as in the second embodiment. For example, one of the bearings may be a slide bearing the other may be a rolling bearing.

The configuration of the slide adjusting device is not limited to the arrangements shown in the above-described embodiments, in which the adjustment annular member and the adjusting drive unit are included, but may be other configurations as long as the vertical distance between the eccentric annular member and the slide can be adjusted.

The press machine is not limited to the four-point type, in which the slide is supported at four points, but may be other desirable types such as a two-point type or a one-point type.

Although the best configuration, method, etc. for implementing the present invention are disclosed above, the present invention is not limited thereto. Specifically, while the particular embodiments of the present invention have been mainly illustrated and described, those skilled in the art may make various modifications to the above embodiments in terms of shape, material, quantity or other details without departing from a scope of a technical idea and an object of the present invention.

Thus, the description that limits the shape and the material or the like is only an example to facilitate the understanding of the present invention, but is not intended to limit the invention, so that the present invention includes the description using a name of components without a part of or all of the limitations on the shape, material or the like.

INDUSTRIAL APPLICABILITY

The present invention is not only applicable to a single press machine, but also to a tandem press in which a plurality of press machines are successively arranged and to a transfer press with which a plurality of working steps are performed with a single press machine.

The invention claimed is:

1. A press machine comprising:

an eccentric shaft;

an eccentric annular member provided to be slidable with respect to an outer circumference of the eccentric shaft, and formed such that an outer circumference is eccentric with respect to an inner circumference;

a slide provided to the outer circumference of the eccentric annular member; and a slide adjusting device adapted to adjust a height position of the slide with respect to the eccentric annular member;

wherein the slide adjusting device includes:

an adjustment annular member formed such that an outer circumference of the adjustment annular member is eccentric with respect to an inner circumference of the adjustment annular member, the inner circumference of the adjustment annular member being slidable with respect to the outer circumference of the eccentric annular member, and the slide being mounted to the outer circumference of the adjustment annular member; and an adjusting drive unit which rotates the adjustment annular member.

2. The press machine according to claim 1, wherein a slide bearing is provided between the eccentric shaft and the eccentric annular member and between the eccentric annular member and the adjustment annular member.

3. The press machine according to claim 1, wherein a rolling bearing is provided between the eccentric shaft and the eccentric annular member and between the eccentric annular member and the adjustment annular member.

4. The press machine according to claim 1, wherein a center of the outer circumference of the eccentric annular member is arranged to be vertically above a rotation center of the eccentric shaft.

* * * * *